United States Patent [19]

Maucione

[11] 4,186,038

[45] Jan. 29, 1980

[54] METHOD OF PRODUCING SILICON-IRON SHEET MATERIAL WITH BORON ADDITION, AND PRODUCT

[75] Inventor: Carl M. Maucione, Cheshire, Mass.

[73] Assignee: General Electric Company, Schenectady, N.Y.

[21] Appl. No.: 781,119

[22] Filed: Mar. 25, 1977

Related U.S. Application Data

[63] Continuation-in-part of Ser. No. 677,147, Apr. 15, 1976, abandoned.

[51] Int. Cl.[2] ..... H01F 1/04

[52] U.S. Cl. ..... 148/113; 148/31.5

[58] Field of Search ..... 148/111, 112, 113, 31.5, 148/27, 16; 204/37, 100; 427/127; 428/432

[56] References Cited

U.S. PATENT DOCUMENTS

| | | | |
|---|---|---|---|
| 3,054,732 | 9/1962 | McQuade | 204/37 |
| 3,222,228 | 12/1965 | Stanley et al. | 148/16 |
| 3,583,887 | 6/1971 | Steger et al. | 148/113 |
| 3,676,227 | 7/1972 | Matsumoto et al. | 148/111 |
| 3,905,842 | 9/1975 | Grenoble | 148/112 |
| 3,905,843 | 9/1975 | Fiedler | 148/111 |
| 3,945,862 | 3/1976 | Lee et al. | 148/113 |
| 3,957,546 | 5/1976 | Fiedler | 148/111 |
| 4,097,343 | 6/1978 | Arendt et al. | 204/100 |
| 4,116,730 | 9/1978 | Arendt et al. | 148/113 |

*Primary Examiner*—L. Dewayne Rutledge
*Assistant Examiner*—John P. Sheehan
*Attorney, Agent, or Firm*—Leo I. MaLossi; Joseph T. Cohen

[57] ABSTRACT

By adding a relatively small amount of boron to the electrolytically-deposited $Mg(OH)_2$ coating on silicon-iron magnetic sheet containing a small but critical amount of boron, a substantial improvement in permeability of the finally-annealed product sheet material can be obtained.

10 Claims, No Drawings

METHOD OF PRODUCING SILICON-IRON SHEET MATERIAL WITH BORON ADDITION, AND PRODUCT

This is a continuation-in-part of my copending patent application Ser. No. 677,147, filed Apr. 15, 1976 (now abandoned), and assigned to the assignee hereof.

The present invention relates generally to the art of producing electrical steel and is more particularly concerned with a novel method of producing singly-oriented slicon-iron sheet through the use of small amounts of boron in the electrically-insulating coating on a boron-containing silicon-iron magnetic sheet.

CROSS REFERENCE

This invention is related to the invention disclosed and claimed in U.S. Patent Application Ser. No. 749,117, filed Dec. 9, 1976 now abandoned, which is a continuation-in-part of patent application Ser. No. 677,146, filed Apr. 15, 1976 (now abandoned), both of which applications were filed in the name of Howard C. Fiedler and were assigned to the assignee hereof and directed to the novel concept of incorporating in the final anneal coating on a boron-containing silicon-iron sheet from six to 90 parts per million boron on the basis of the silicon-iron sheet, the alloy sheet itself containing boron and nitrogen in the ratio of one to 15 parts per part of boron.

The disclosure of those Fiedler patent applications and particularly that information and data set forth in Examples I, II and III thereof are incorporated herein by reference.

BACKGROUND OF THE INVENTION

The sheet materials to which this invention is directed are usually referred to in the art as "electrical" silicon steels or, more properly, silicon-irons and are ordinarily composed principally of iron alloyed with about 2.2 to 4.5 percent silicon and relatively minor amounts of various impurities and very small amounts of carbon. These products are of the "cube-on-edge" type, more than about 70 percent of their crystal structure being oriented in the (110) [001] texture, as described in Miller Indices terms.

Such grain-oriented silicon-iron sheet products are currently made commercially by the sequence of hot rolling, heat treating, cold rolling, heat treating, again cold rolling and then final heat treating to decarburize, desulfurize and recrystallize. Ingots are conventionally hot-worked into a strip or sheet-like configuration less than 0.150 inch in thickness, referred to as "hot-rolled band." The hot-rolled band is then cold rolled with appropriate intermediate annealing treatment to the finished sheet or strip thickness usually involving at least a 50 percent reduction in thickness, and given a final or texture-producing annealing treatment.

As disclosed and claimed in U.S. Pat. No. 3,905,842, issued Sept. 16, 1975, to Herbert E. Grenoble and assigned to the assignee hereof, the magnetic properties of such sheet materials can be very considerably improved by incorporating boron in the metal so that it is present there in critical proportion to the nitrogen content of the metal at the time of the final or texture-developing anneal. As stated in that patent, the amount of boron required to produce that result is quite small but highly critical.

Similarly, it is disclosed in U.S. Pat. No. 3,905,843, issued Sept. 16, 1975, to Howard C. Fiedler and assigned to the assignee hereof, that such use of boron in the metal in proportion to nitrogen while maintaining the ratio of manganese to sulfur at less than 2.1 will enable the corresponding substantial improvement in magnetic properties of a product made by the process including cold rolling in two stages, including an intermediate anneal.

Still another related disclosure concerning the use of small but critical amounts of boron in silicon-iron is set forth in U.S. Pat. No. 3,957,546, issued May 18, 1976 Howard C. Fiedler and, assigned to the assignee hereof, which is directed to the novel concept of cold rolling hot-rolled silicon-iron sheet directly to final thickness without an intermediate heat treatment through the use of small but critical amounts of boron and by maintaining the ratio of manganese to sulfur in the metal at less than 1.8.

SUMMARY OF THE INVENTION

I have discovered that under certain conditions the presence of boron in the usual electrically-insulating coating on silicon-iron sheet material can have a beneficial effect upon the secondary recrystallization of the metal to develop the (110) [001] texture and special magnetic properties associated with it. In particular, I have found that the presence of a very small amount of boron in the coating during the final anneal results in the development of substantially better magnetic properties than would otherwise be produced. It can, in fact, cause secondary recrystallization to take place when otherwise it would not. I have also determined, however, that the presence of boron in the insulating coating during the final anneal is not effective in this respect if there is substantially no boron present in the metal itself at the outset of the final anneal. It follows, however, that by virtue of this invention one can substantially reduce the amount of boron added to the ladle in accordance with the foregoing two patents and patent application for whatever advantage and without penalty to the desirable properties of the ultimate silicon-iron sheet product attributable to the presence of boron during the final anneal.

These discoveries are surprising, especially in view of the fact that quite different results are obtained when boron is added to the final anneal coating on silicon-iron sheet containing no boron. Thus, according to U.S. Pat. No. 3,676,227 to Matsumoto et al., such additions result in smaller secondary grains that the average but no improvement in permeability, whereas grain size is not diminished while permeability is substantially improved by the present invention process.

I have also found that while the amount of boron in the coating necessary to produce my new results is both critical and quite small, it is not a difficult requirement to meet. In fact, one has the choice of applying the boron with the $Mg(OH)_2$ or other similar electrically-insulating coating material in slurry form or, alternatively, forming the coating as disclosed in U.S. Pat. No. 3,054,732 (issued Sept. 18, 1962 to McQuade and assigned to the assignee hereof) and then contacting the coated sheet metal with an aqueous solution of a boron compound. The latter procedure may take the form of a dipping operation or the aqueous solution may be brushed on the coating or even sprayed on, if desired.

Additionally, I have found that $H_3BO_3$ and $Na_2B_4O_7$ are desirable boron sources according to this invention, and I contemplate their use for this purpose individually or in combination. Further, those skilled in the art will understand that other boron sources compatible with the final anneal environment for the purposes of this invention may also or alternatively be used in the coating.

From the foregoing it will be understood that this invention has both method and article or product aspects. The product is a fine-grained, primary-recrystallized, magnetic, silicon-iron sheet of final gauge thickness having a boron-containing coating of magnesium hydroxide or the like. By virtue of the content of boron, nitrogen, manganese and sulfur in the sheet and the boron in the coating, the silicon-iron sheet can be converted to the singly oriented state in which it will have valuable magnetic properties but may not contain much, if any, of the boron which enabled the development of those properties during the final anneal through secondary recrystallization.

The proces of producing this new intermediate, coated, silicon-iron product is also new, as is the overall process of producing the final desired grain-oriented sheet material.

Briefly described, in its article aspect this invention takes the form of an electrically-insulated magnetic sheet of fine-grained, primary-recrystallized, magnetic, silicon-iron which contains three to 50 parts per million boron and has a thin, tightly-adhering, boron-containing coating of a water-insoluble hydroxide of calcium, magnesium, manganese or aluminum. Preferably, the amount of boron in the coating should be between about 25 and 150 parts per million on the basis of the silicon-iron sheet substrate, and for optimum results in terms of limiting core losses should be between 50 and 80 ppm on the same basis. Further, these ranges apply independently of the boron content of the silicon-iron sheet substrate as long as the latter is within the three to 50 ppm range stated above.

Similarly described, the method of this invention comprises the steps of providing this intermediate sheet product and subjecting it to a final heat treatment to develop the cube-on-edge secondary recrystallization in it.

DETAILED DESCRIPTION OF THE INVENTION

In carrying out this invention, one may provide the intermediate sheet product described above by preparing a silicon-iron metal of the required chemistry, and then casting and hot rolling to intermediate thickness. Thus, the melt on pouring will contain from 2.2 to 4.5 percent silicon, manganese and sulfur in amounts in a ratio of manganese to sulfur less than 2.3, from about three to 50 ppm boron and about 15 to 95 ppm nitrogen in the ratio range to boron of one and 15 parts to one, the remainder being iron and small amounts of incidental impurities including carbon, aluminum, copper and oxygen. Following anneal, the hot band is cold rolled with or without intermediate anneal to final gauge thickness and then decarburized.

The resulting fine-grained, primary-recrystallized, silicon-iron sheet material in whatever manner produced is processed to provide the essential born-containing coating of this invention in preparation for the final texture-developing anneal. Preferably, the coating step is accomplished electrolytically as described in U.S. Pat. No. 3,054,732, referenced above, a 0.2 mil thickness coating of $Mg(OH)_2$ thereby being applied to the sheet. The coated sheet is then dipped in aqueous solution of boric acid or sodium borate or other suitable boron compound solution which is preferably relatively dilute, containing of the order of five to 10 grams per liter of the boron compound.

As the final step of the process of this invention, the thus-coated sheet is heated in hydrogen or a mixture of nitrogen and hydrogen to cause secondary grain growth which begins at about 950° C. As the temperature is raised at about 50° C. per hour to 1000° C., the recrystallization process is completed and heating may be carried on to up to 1175° C. if desired to insure complete removal of residual carbon, sulfur and nitrogen.

The following illustrative, but not limiting, examples of my novel process as actually carried out with the new results indicated above will further inform those skilled in the art of the nature and special utility of this invention.

EXAMPLE I

Strips of silicon-iron of the following composition were prepared as described in U.S. Pat. No. 3,905,843 referred to above:

| | |
|---|---|
| Carbon | 0.030% |
| Manganese | 0.035% |
| Sulfur | 0.031% |
| Boron | 0.0010% |
| Nitrogen | 0.0050% |
| Copper | 0.24% |
| Aluminum | 0.005% |
| Iron | Remainder |

From this melt composition, 10.8-mil and 13.6-mil sheets were produced in a series of hot rolling passes followed by pickling and annealing of the intermediate thickness sheet material (about 100 mils). Cold rolling was then carried on to 60 mils thickness, whereupon the material was reheated and cold rolled again to final thickness and the cold-worked sheet was given a decarburizing heat treatment at 800° C. for eight minutes in hydrogen (room temperature dew point).

Epstein strips cut from the sheets were provided with a coating of $Mg(OH)_2$ of 0.2-mil thickness as described in U.S. Pat. No. 3,054,732-McQuade, particularly Example II thereof.

Three of each of the 10.8-mil and 13.6-mil strips were selected for tests of this invention process, one of each group being a control sample and so not being provided with boron in the magnesia coating. Another of each group was dipped in a five-gram-per-liter solution of sodium borate for 15 seconds, while the third was dipped in a ten-gram-per-liter solution of sodium borate for 15 seconds. The six strips were then annealed at 1160° C. in hydrogen for five hours. The magnetic properties of the resulting strip materials are set forth in Table I:

TABLE I

| Sample | $Na_2B_4O_7$ Dipping Solution (gm/l) | MWPP (Coated) 15 kG | MWPP (Coated) 17 kG | $\mu$ at 10H (Coated) |
|---|---|---|---|---|
| 11-1H 0 | 0 | 598 | 898 | 1799 |
| 11-1H 5 | 5 | 687 | 972 | 1806 |
| 11-1H 10 | 10 | 594 | 840 | 1881 |
| 14-1H 0 | 0 | 710 | 1050 | 1743 |
| 14-1H 5 | 5 | 864 | 1240 | 1707 |
| 14-1H 10 | 10 | 740 | 1040 | 1801 |
| 11-1B 0 | 0 | 661 | 1000 | 1729 |

TABLE I-continued

| Sample | $Na_2B_4O_7$ Dipping Solution (gm/l) | MWPP (Coated) 15 kG | 17 kG | μ at 10H (Coated) |
|---|---|---|---|---|
| 11-1B 5 | 5 | 646 | 908 | 1834 |
| 11-1B 10 | 10 | 663 | 992 | 1747 |
| 14-1B 0 | 0 | 665 | 988 | 1767 |
| 14-1B 5 | 5 | 725 | 1060 | 1797 |
| 14-1B 10 | 10 | 760 | 1084 | 1778 |

EXAMPLE II

Two Epstein packs of additional strips of 10.7-mil and 10.8-mil sheet materials were prepared and electrolytically-coated as described in Example I and then immersed in a 7.5 gram-per-liter aqueous solution of $Na_2B_4O_7$ for 15 seconds. Epstein packs of the resulting strips were subjected to the final anneal of Example I with the results indicated in Table II:

TABLE II

| Pack | MWPP 15 | 16.3 | 17 | μ at 10H |
|---|---|---|---|---|
| 1H Lab Anneal | 584 | 714 | 808 | 1842 |
| 1H Lab Anneal | 581 | 715 | 807 | 1834 |

EXAMPLE III

In another experiment involving the process of this invention, a commercial melt prepared through the use of BOF silicon-iron as described in above U.S. Pat. No. 3,905,843 was used, its ladle composition being:

| | |
|---|---|
| Silicon | 3.10% |
| Copper | 0.26% |
| Manganese | 0.032% |
| Sulfur | 0.014% |
| Carbon | 0.024% |
| Boron | 0.0015% |
| Nitrogen | 0.0035% |

Hot rolling and direct cold rolling to final gauge thickness about 11 mils were carried out as set forth in referenced copending patent application Ser. No. 749,117. Cold-rolled material was decarburized and provided with a magnesia coating in accordance with the McQuade-732 patent, and then dipped in solution consisting of 142 gallons of water, 15 pounds of boric acid and four pints of ammonia. About 50 parts per million boron (steel equivalent) were thereby incorporated in the magnesia coating.

The resulting coated strips were then annealed at 2150° F. in dry hydrogen for three hours.

The ultimate, finally-annealed specimens were found to have good magnetic properties, permeability being 1905 Gausses per oersted (in a 10-oersted field) with losses measuring 0.468 and 0.629 watts per pound at 15,000 and 17,000 gausses, respectively.

EXAMPLE IV

In still another test of this invention, a mill heat was prepared as above described of the following ladle composition:

| | |
|---|---|
| Silicon | 3.15% |

-continued

| | |
|---|---|
| Copper | 0.26 |
| Manganese | 0.32 |
| Sulfur | 0.14 |
| Carbon | 0.26 |
| Phosphorus | 0.005 |
| Chromium | 0.06 |
| Nickel | 0.091 |
| Titanium | 0.004 |
| Tin | 0.011 |
| Boron | 0.0011 |
| Nitrogen | 0.0035 |
| Iron | Balance |

Mn/S = 2.29

Again, hot rolling and direct cold rolling to final gauge thickness (10.6 mils) were conducted as set forth in copending patent application Ser. No. 749,117.

This material was finally normalized and electrolytically coated with 0.2 mil magnesia per the McQuade patent, and mill-dipped in a one percent boric acid solution prepared as described in Example III. Epstein pack specimens from several coils were redipped in a laboratory one percent boric acid solution. Two other specimens from each coil were redipped, respectively, in two percent and three percent boric acid solutions in the laboratory. One analysis, the boron contents of the coatings were found as set forth in Table III which also lists the magnetic properties measured in these strips following annealing as Epstein packs at 2150° F. in dry hydrogen for three hours.

TABLE III

| | Lot | 17 kG Loss mwpp | μ 10H | Coating Boron* mg/strip |
|---|---|---|---|---|
| 1 | Final | 656 | 1876 | 0 |
| | Normalize | | | |
| | Mill Dip | 692 | 1872 | 0.68 |
| | 1% | 674 | 1909 | 1.24 |
| | 2% | 707 | 1885 | 1.72 |
| | 3% | 705 | 1887 | 2.20 |
| 2 | Final | 670 | 1886 | 0 |
| | Normalize | | | |
| | Mill Dip | 640 | 1900 | 1.57 |
| | 1% | 649 | 1912 | 2.06 |
| | 2% | 659 | 1921 | 2.86 |
| | 3% | 711 | 1906 | 2.88 |
| 3 | Final | 656 | 1870 | 0 |
| | Normalize | | | |
| | Mill Dip | 643 | 1886 | 0.89 |
| | 1% | 653 | 1909 | 1.33 |
| | 2% | 658 | 1907 | 2.13 |
| | 3% | 688 | 1886 | 2.50 |

*One milligram per Epstein strip = 50 parts per million silicon-iron equivalent.

What I claim as new and desire to secure by Letters Patent of the United States is:

1. The method of producing grain-oriented silicon-iron sheet of enhanced magnetic properties which comprises the steps of providing a fine-grained, primary-recrystallized, silicon-iron sheet containing 2.2 to 4.5 percent silicon, between about three and 50 parts per million boron, amounts of manganese and sulfur within a ratio of manganese to sulfur less than 2.3, and between about 30 and 90 parts per million nitrogen in the ratio to boron of one to 15 parts per part of boron, covering the sheet with an adherent electrically-insulating coating containing boron in amount effective to cause secondary recrystallization of the silicon-iron sheet during final heat treatment, and subjecting the coated sheet to a final sheet heat treatment to develop (110) [001] secondary recrystallization texture in the silicon-iron sheet.

2. The method of claim 1 in which the boron in the coating is in the form of boric acid.

3. The method of claim 1 in which the boron in the coating is in the form of sodium borate.

4. The method of claim 1 including the steps of forming an electrically-insulating coating on the sheet and then contacting the then-coated sheet with an aqueous solution of a boron compound.

5. The method of claim 4 in which the aqueous solution contains about five grams-per-liter of $Na_2B_4O_7$.

6. The method of claim 4 in which the aqueous solution contains about ten grams-per-liter of $Na_2B_4O_7$.

7. The method of claim 4 in which the boron compound is boric acid and the solution contains between one and 15 grams-per-liter of said acid.

8. The method of claim 1 in which the boron content of the coating is equivalent to between about 50 and 80 parts per million on the basis of the silicon-iron sheet.

9. An electrically-insulated magnetic sheet material of enhanced magnetic properties comprising a fine-grained, primary-recrystallized, magnetic, silicon-iron sheet containing between three and 50 parts per million boron, amounts of manganese and sulfur within a ratio of manganese to sulfur less than 2.3, and between about 30 and 90 parts per million nitrogen and having thereon a thin and tightly-adherent coating of a water-insoluble hydroxide of a metal selected from the group consisting of calcium, magnesium, manganese and aluminum containing boron in amount effective to cause secondary recrystallization of the silicon-iron sheet during final anneal.

10. The sheet material of claim 9 in which the coating is an electrolytic $Mg(OH)_2$ coating, the silicon-iron sheet contains about ten parts per million boron and about 30 parts per million nitrogen, and the coating contains between about 50 and 80 parts per million boron on the basis of the silicon-iron sheet.

* * * * *